United States Patent [19]

Feldi

[11] Patent Number: 4,834,393

[45] Date of Patent: May 30, 1989

[54] BALL GRABBER

[76] Inventor: Joseph A. Feldi, 4443 NW. 5th Ave., Boca Raton, Fla.

[21] Appl. No.: 135,983

[22] Filed: Dec. 21, 1987

[51] Int. Cl.[4] ..... A63B 39/00; A63B 49/00

[52] U.S. Cl. ..... 273/61 B; 273/61 R; 273/73 R; 273/73 C; 273/DIG. 30

[58] Field of Search ..... 273/DIG. 26, DIG. 30, 273/73 D, 73 C, 61 R, 61 B

[56] References Cited

U.S. PATENT DOCUMENTS

| | | | |
|---|---|---|---|
| 3,874,666 | 4/1975 | Ross | 273/DIG. 30 |
| 4,053,156 | 10/1977 | Bai | 273/34 |
| 4,240,639 | 12/1980 | Bolton et al. | 273/58 B |

*Primary Examiner*—Robert E. Garrett
*Assistant Examiner*—Thomas Denion

[57] ABSTRACT

The Ball Grabber is a concept or idea using the two components of the Velcro or any brand hook and loop fastening system. Using these two components in any form or manner to retrieve a tennis ball. One being a tennis ball constructed on the exterior surface, entirely of the loop material. Secondly, using a piece of the hook material approximately 4" long and ½" wide being fastened to the end or tip of a tennis racquet with adhesive. When the tip of the racquet is lightly touched to a tennis ball on the ground the ball will attach itself temporarily to the racquet tip, avoiding one having to bend over to pick up the ball.

1 Claim, 1 Drawing Sheet

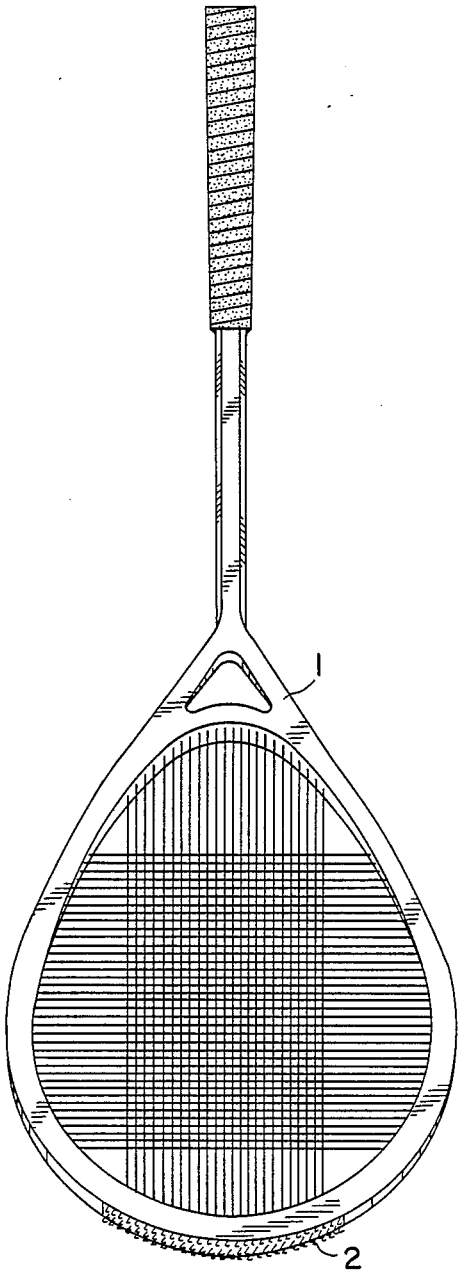
FIG. 1
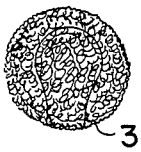
FIG. 2
FIG. 3
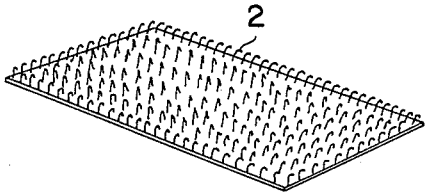
FIG. 4
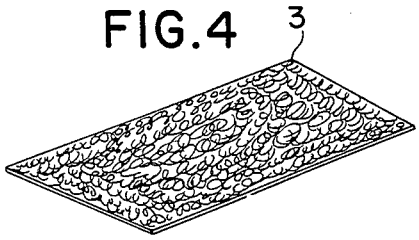

BALL GRABBER

BACKGROUND OF THE INVENTION

Field of the invention, a simple system of retrieving a tennis ball off the ground during a game is needed. This system needs to be incorporated into or onto a tennis racquet so the player would not have to carry any other device. Also, it would be important not to add any weight or wind resistance or a dangerous protruding device to the tennis racquet. Finally, once affixed to the racquet the ball should be easily removeable.

DESCRIPTION OF PRIOR ART

U.S. Pat. No. 3,874,666, 4/1975 Ross, In FIG. 1, Item 16 a hook material (ex. velcro) is affixed to the end of the tennis racquet. This system will pick up a tennis ball, but it has two major draw backs. First; it is very difficult to pick up a standard tennis ball with this system, the standard material covering is not compatible with the hook fastener system. Therefore, it may only attach one out of five times. Problem two; after just a few retrievals using a standard tennis ball, the ball covering becomes fuzzy and no longer useful in normal play.

SUMMARY OF THE INVENTION

As previously sited in prior art, two problems exist in the Ross ball retrieval system. The proper method to solve this problem would be to construct a new revolutionary tennis ball that would be compatible with a hook fastening system. This system would incorporate an entirely new covering on a tennis ball. This new covering would be the loop material of a hook and loop fastening system; (example—The Velcro hook & loop fastening system). Now, by simply affixing a strip of hook component fastener to the tip of the tennis racquet and touching this to the new style tennis ball the ball is retrieved without stooping. Also, once retrieved, the ball is easily manually removed for further play. Also, the cycle life (attaching and detaching) is far superior to that of a standard tennis ball.

DESCRIPTION OF DRAWINGS

FIG. 1 Fragmentary view of a tennis racquet

FIG. 2 Hook fastener affixed to tip of tennis racquet

FIG. 3 New revolutionary tennis ball covered with loop fastener

FIG. 4 Sample of loop fastener

FIG. 5 Sample of hook fastener

DESCRIPTION OF THE PREFERRED EMBODIMENT

The tennis racquet in FIG. 1 is held in the usual manner by the player. The Velcro hook fastener in FIG. 2 which is attached to FIG. 1 makes up one half of the ball retrieving system. To retrieve a ball on the ground, the player touches the tip of racquet FIG. 1 at the point where the fastener is attached FIG. 2 to the ball FIG. 3. The tennis ball is immediately connected to the tennis racquet in FIG. 1. FIG. 4 is a sample of the loop fastener and FIG. 5 is a sample of the hook fastener.

I claim:

1. A tennis ball retrieval means consisting of a tennis racquet, and a hook and loop fastening means; said tennis racquet having a handle portion in opposing relationship therebetween; said hook fastening means adhesively attached to said racquet tip, said loop fastening means consisting of an outer covering of a tennis ball consisting entirely of a loop material.

* * * * *